United States Patent [19]

Yannascoli et al.

[11] 4,389,168

[45] Jun. 21, 1983

[54] APPARATUS FOR MODULATING THE CAPACITY OF A RECIPROCATING COMPRESSOR

[75] Inventors: Donald Yannascoli, Fayetteville; Bruce A. Fraser, Manlius, both of N.Y.

[73] Assignee: Carrier Corporation, Syracuse, N.Y.

[21] Appl. No.: 248,388

[22] Filed: Mar. 27, 1981

[51] Int. Cl.[3] ..... F04B 49/00; F25B 1/00

[52] U.S. Cl. ..... 417/298; 62/228

[58] Field of Search ..... 417/278, 298, 299, 440, 417/441; 62/228 C

[56] References Cited

U.S. PATENT DOCUMENTS

| | | | |
|---|---|---|---|
| 816,964 | 4/1906 | Clark | 417/298 |
| 1,931,833 | 10/1933 | Sparacino | 417/298 |
| 2,626,099 | 1/1953 | Ashley | 417/298 |
| 3,166,236 | 1/1965 | Michener | 417/298 |
| 3,490,683 | 1/1970 | Kocher | 417/298 |
| 3,759,057 | 9/1973 | English et al. | 62/196 |
| 3,844,686 | 10/1974 | Le Blanc | 417/298 |

*Primary Examiner*—John J. Camby

*Attorney, Agent, or Firm*—Donald F. Daley; David J. Zobkiw

[57] ABSTRACT

Apparatus for modulating the capacity of a reciprocating compressor having a cylinder chamber and a valve assembly extending over the cylinder chamber, defining fluid inlet and outlet paths, and including a suction valve for regulating vapor flow through the inlet path. The capacity modulating apparatus comprises a lever, a fulcrum, and control means. The lever extends through the fluid inlet path and above the suction valve, and has a first end located outside the valve assembly and a second end engaging the suction valve. Both the fulcrum and the control means engage the lever, and the control means is provided for applying a variable force to the lever wherein the lever transmits the force to the suction valve to urge the suction valve to an open position.

4 Claims, 3 Drawing Figures

APPARATUS FOR MODULATING THE CAPACITY OF A RECIPROCATING COMPRESSOR

BACKGROUND OF THE INVENTION

This invention generally relates to capacity control apparatus for compressors, and more specifically to apparatus for modulating the capacity of a reciprocating compressor.

Considerable attention has been and continues to be directed toward designing heat pump systems which effectively satisfy a relatively large heating load at one time and, at a different time, efficiently meet a comparatively small cooling load. Such heat pump systems would be particularly well suited, for example, for use in the northern regions of the United States. One basic design approach is to provide a heat pump system with a single compressor having a capacity large enough to satisfy the common, large loads placed on the compressor when the heat pump system is used to heat a room or area. Such a compressor, however, has a capacity which is much larger than what is needed to satisfy the usually low loads placed on the compressor when the heat pump system is employed to cool the room or area served thereby, and preferably the compressor operation is controlled or governed in some manner to inhibit overcooling of this room or area and to reduce the associated wasted energy and unnecessary operating costs.

For example, the compressor may simply be cycled on and off as the room or area temperature fluctuates above and below a preset value. This particular arrangement, however, may result in frequent cycling of the compressor into and out of operation, and as is understood in the art, various undesirable characteristics such as reduced lubrication and excessive noise may occur if a compressor is cycled on and off too frequently. For these, and other reasons, simply cycling the compressor on and off to satisfy a low cooling load is often not favored. Alternatively, the compressor may be provided with capacity control apparatus for varying the mass of compressed vapor discharged from the compressor, allowing the compressor to operate continuously for longer periods of time even though only a relatively low load is placed on the compressor. Prior art compressor capacity control apparatus, though, are not as well suited as might be desired for use with compressors which are used in the heat pump applications described above. For example, many compressor capacity control devices reduce the compressor capacity through discrete steps. While this may improve compressor efficiency, in many circumstances the compressor will still cycle on and off much more frequently than is preferred. Further, many prior art compressor capacity control apparatus are expensive to manufacture and are generally complex, and thus may be difficult to install, calibrate, and operate accurately.

SUMMARY OF THE INVENTION

In view of the above, an object of the present invention is to improve compressor capacity control apparatus, and specifically to improve apparatus for modulating the capacity of a reciprocating compressor.

Another object of this invention is to provide a compressor capacity control apparatus which is particularly well suited for use in heat pump applications having large heating loads and small cooling loads.

A further object of the present invention is to modulate the capacity of a compressor over a wide range of compressor loads.

Still another object of this invention is to adjust the capacity of a reciprocating compressor by means of a compact and simple capacity control device which does not require modification of the compressor cylinder chamber.

These and other objectives are attained with apparatus for modulating the capacity of a reciprocating compressor having a cylinder chamber and a valve assembly extending over the cylinder chamber, defining fluid inlet and outlet paths, and including a suction valve for regulating vapor flow through the inlet path. The capacity modulating apparatus comprises a lever, a fulcrum, and control means. The lever extends through the fluid inlet path and above the suction valve, and has a first end located outside the valve assembly and a second end engaging the suction valve. Both the fulcrum and the control means engage the lever, and the control means is provided for applying a variable force to the lever, wherein the lever transmits the force to the suction valve to urge the suction valve to an open position.

A BRIEF DESCRIPTION OF THE DRAWINGS

A DETAILED DESCRIPTION OF THE PREFERRED EMBODIMENT

Figure 1:
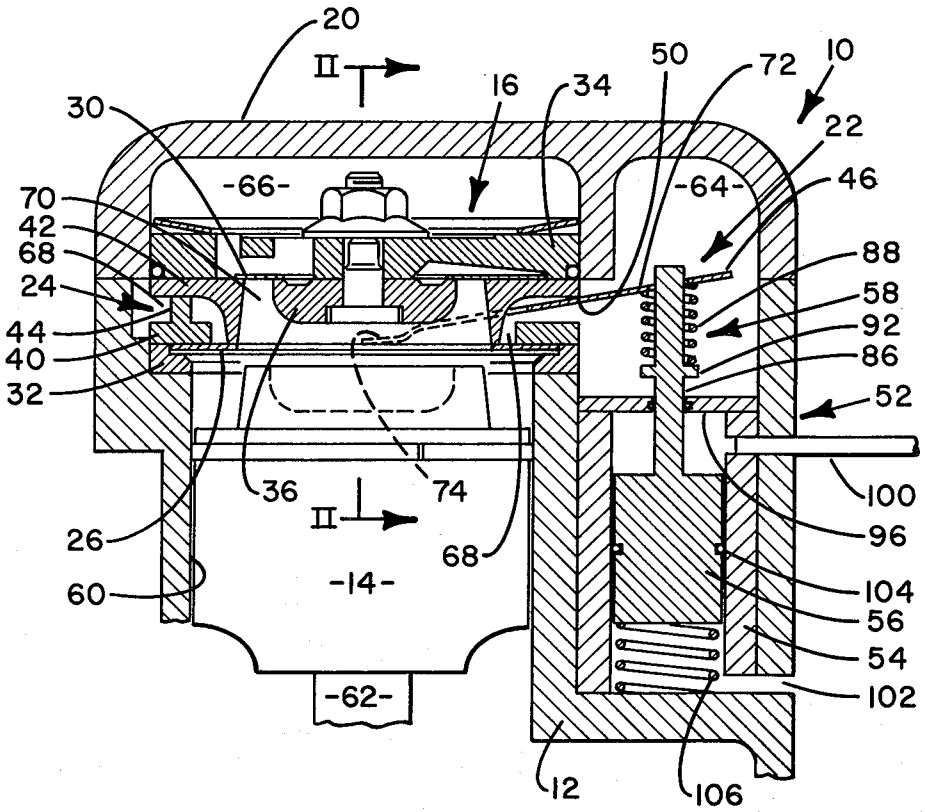
FIG. 1 is a longitudinal, cross sectional view showing portions of a compressor employing a preferred embodiment of the capacity modulating apparatus of the present invention.
Figure 3:
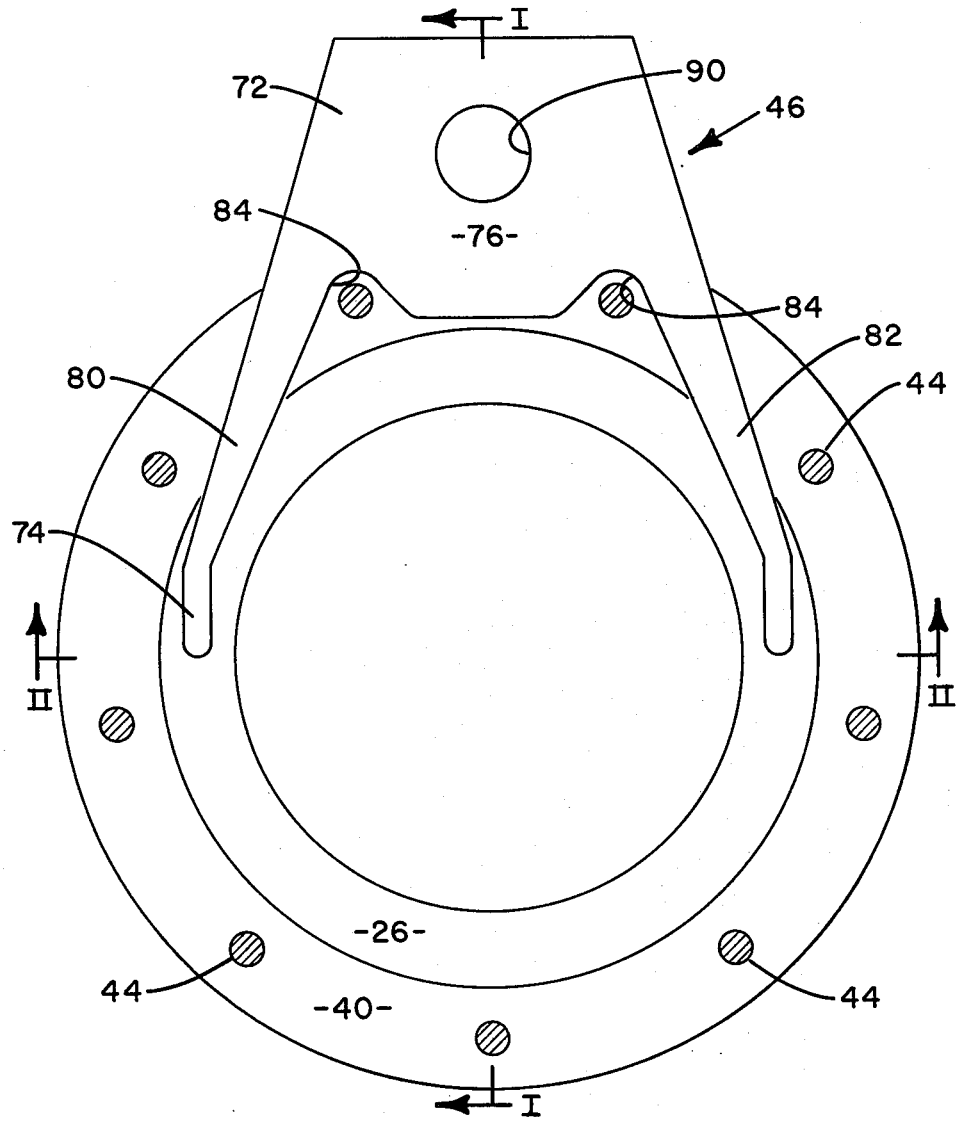
FIG. 3 is a top view showing the suction valve, the control lever, and portions of the valve assembly depicted in FIGS. 1 and 2.
Figure 2:
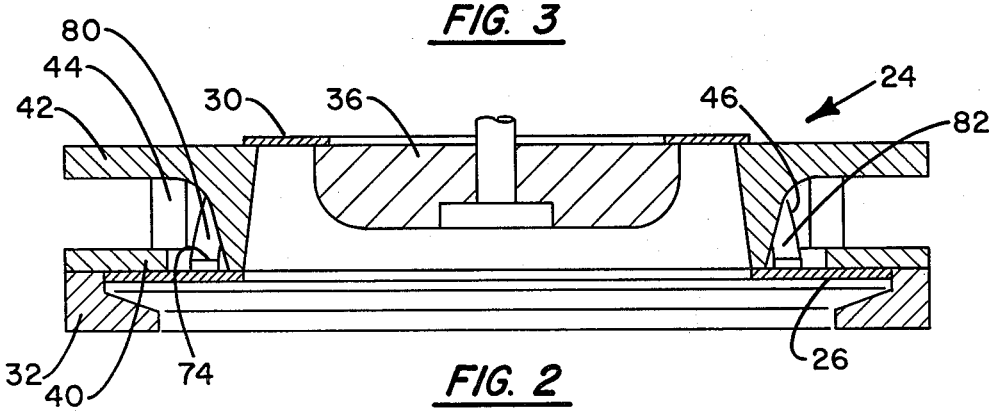
FIG. 2 is a cross sectional view of lower portions of the valve assembly of the compressor shown in FIG. 1, and taken along line II—II thereof.

Particularly referring to FIG. 1, there is illustrated portions of compressor 10 incorporating teachings of the present invention. Compressor 10 includes cylinder block 12, piston 14, valve assembly 16, cylinder head 20, and capacity control apparatus 22. Valve assembly 16 generally includes valve plate 24, suction valve 26, discharge valve 30, suction valve guide 32, discharge valve guide 34, and inner seat 36. Valve plate 24, in turn, includes first and second members 40 and 42 and upstanding members, shown as cylindrical pins 44, extending therebetween. Capacity control apparatus 22 generally comprises lever 46, fulcrum 50, and control means 52; and control means 53 preferably includes housing 54, piston 56, and lever engaging means 58.

As is conventional, cylinder block 12 defines cylinder chamber 60, and piston 14 is reciprocally disposed therewithin. Piston 14 is connected via connecting rod 62 to a rotatable crankshaft (not shown), wherein rotation of the crankshaft causes the piston to reciprocate within cylinder chamber 60 to compress gas drawn thereinto. Valve assembly 16 extends over cylinder chamber 60, and cylinder head 20 extends over both the valve assembly and cylinder block 12. Cylinder head 20 is conventionally secured to cylinder block 12, securely holding valve assembly 16 and the component parts thereof between the cylinder head and cylinder chamber 60. Cylinder block 12 and cylinder head 20 cooperate to define suction plenum 64, while the cylinder head and valve assembly 16 define discharge plenum 66.

Valve assembly 16 defines fluid inlet and outlet paths 68 and 70 for conducting fluid from suction plenum 64 into cylinder chamber 60 and from the cylinder chamber into discharge plenum 66 respectively. More specifically, first and second members 40 and 42 of valve plate 24 are spaced apart, defining curved, vapor inlet path 68 therebetween. Members 40 and 42, it should be noted, are connected together via pins 44, which preferably are integral with member 40, extend upward through fluid inlet path 68, and are suitably joined, for example by resistance welding or a similar known technique, to second member 42. At the same time, discharge valve guide 34 is disposed outside and contiguous to valve plate 24, specifically second member 42 thereof, and inner seat 36 is located below and is conventionally secured to the discharge valve guide. Inner seat 36 is located radially inside valve plate 24, and the inner seat and the valve plate are radially spaced apart, defining fluid outlet path 70 therebetween.

Suction valve 26 regulates vapor flow through fluid inlet path 68. More particularly, suction valve guide 32 is contiguous to an outside shoulder of cylinder block 12, and valve plate 24 abuts against an outside shoulder of the suction valve guide. An inside shoulder of suction valve guide 32 is slightly spaced from valve plate 24, and suction valve 26 is captured within the space between the suction valve guide and the valve plate, below fluid inlet path 68. Preferably, suction valve 26 comprises an annular plate or ring, and in a closed position, the suction valve seats against valve plate 24, covering fluid inlet path 68 and preventing vapor flow therethrough. In an open position, suction valve 26 is spaced from valve plate 24, allowing fluid flow through inlet path 68.

Similarly, discharge valve 30 regulates fluid flow through fluid outlet path 70. Portions of discharge valve guide 34 are spaced from both valve plate 24 and inner seat 36, and discharge valve 30 is captured within this space, above fluide outlet path 70. In a closed position, discharge valve 30 seats against valve plate 24 and inner seat 36, covering fluid outlet path 70 and preventing vapor flow therethrough; while in an open position, the discharge valve is spaced from the valve plate and the inner seat, allowing vapor flow through the fluid outlet path. It should be pointed out that preferably suction valve 26 is radially outside fluid outlet path 70 and does not interfere with the vapor flow therethrough.

In operation, typically compressor 10 is enclosed within a shell or casing which is filled with low pressure vapor, and low pressure vapor is conducted into suction plenum 64 via a vapor inlet line (not shown). From suction plenum 64, the vapor passes into vapor inlet path 68. As piston 14 moves downward within cylinder chamber 60, the vapor pressure above suction valve 26 forces the valve open, and vapor enters the cylinder chamber. As piston 14 moves upward within cylinder chamber 60, the piston compresses vapor therewithin, forcing suction valve 26 closed and opening discharge valve 30. The compressed vapor passes through vapor outlet path 70, into discharge plenum 66, and therefrom the vapor is discharged from compressor 10 via a compressor discharge line (not shown).

As indicated above, substantial attention has been recently directed toward employing compressors of the general type described above in heat pump systems subjected to large heating loads and low cooling loads, and one difficulty encountered in utilizing a compressor in such a system involves varying or adjusting the capacity of the compressor so that the compressor will satisfy a low load without frequently cycling on and off. In accordance with teachings of the present invention, capacity control apparatus 22 may be effectively used to modulate the capacity of compressor 10 accurately, reliably, and comparatively simply over a relatively large range of loads, thus permitting the compressor to operate continuously for significant lengths of time even though only low, partial loads are placed on the compressor.

Referring to capacity control apparatus 22 in greater detail, lever 46 extends through fluid inlet path 68, above suction valve 26, and the lever has first end 72 located outside valve assembly 16 and second end 74 engaging the suction valve. Both fulcrum 50 and control means 52 engage lever 46, and the control means is provided for applying a variable force to the lever, wherein the lever transmits the force to suction valve 26 to urge the suction valve to an open position.

As will be appreciated by those skilled in the art, by applying this force to suction valve 26 urging the suction valve to the open position, capacity control apparatus 22 of the present invention effectively delays the closing of the suction valve as piston 14 moves upward within cylinder chamber 60. This allows vapor being compressed within cylinder chamber 60 to pass therefrom into and through fluid inlet path 68. This decreases the mass of compressed vapor passing into and through fluid outlet path 70 and discharge plenum 66, reducing the capacity of compressor 10. By varying the control force applied to lever 46, the force applied by the lever to suction valve 26 may be varied, adjusting the extent to which capacity control apparatus 22 delays the closing of suction valve 26. In this manner, the mass of compressed vapor discharged from cylinder chamber 60 via vapor inlet line 68 may be increased or decreased in essentially infinitely small steps or increments, gradually modulating the capacity of compressor 10.

Referring now to all three Figures in the drawings, preferably lever 46 includes shoulder 76 and first and second spaced arms or forks 80 and 82. Shoulder 76 projects radially outside valve assembly 16, and arms 80 and 82 extend from the shoulder into engagement with top, opposed sides of suction valve 26. With this preferred arrangement, fulcrum 50 is defined by valve assembly 16, specifically an outside edge of valve plate 24, and the fulcrum engages in intermediate portion of lever 46, specifically an inside portion of shoulder 76. Moreover, preferably lever 46 defines a plurality of recesses 84 and pins 44 extend through these recesses, limiting lateral movement of the lever to assist maintaining the lever in position within compressor 10. It should also be noted that preferably lever 22 is formed from thin gauge spring steel wherein the lever is flexible and will bend as the force applied thereto by control means 52 increases so that the lever does not totally prevent suction valve 26 from closing.

Turning now to control means 52, as indicated earlier, the control means preferably includes housing 54, piston 56, and lever engaging means 58. Piston 56 is slidably disposed within housing 54, and lever engaging means 58 is connected to the piston and extends therefrom into engagement with lever 46. With the preferred embodiment illustrated in the drawings, housing 54 is located in suction plenum 64, adjacent to cylinder chamber 60, and piston 56 is disposed in close, sliding fit against interior surfaces of the housing. Also, lever engaging means 58 preferably includes piston stem 86 and coupling means such as spring 90. Stem 86, which may be integral with piston 56, extends upward from the top of the piston, through opening 92 defined by lever 46 and thus helps to maintain the lever in its proper position. Spring 90 extends between stem shoulder 94 and the undersurface of lever 46 to transmit force therebetween while still allowing limited angular movement between the lever and lever engaging means 58. Stem 86, it should be noted, extends through spring 90, limiting transverse movement and guiding axial movement thereof.

Control means 52 also includes means for applying a variable control force to piston 56, wherein the piston and lever engaging means 58 transmit the control force to lever 46, which in turn transmits the force to suction valve 26. As will be understood by those skilled in the art, the means for applying a variable control force to piston 56 may take many forms. One type of control, as an illustration, is to adjust a vapor pressure within housing 54, for example the vapor pressure within the housing and above piston 56, in response to the load on compressor 10. If this type of control is employed, preferably the top of housing 54 is covered by plate 96, which may be secured in place in any suitable manner, and the upper portion of housing 54 is connected to a suitable source of control pressure via conduit 100. In addition, preferably the lower portion of housing 54 is vented to the exterior of cylinder block 12, which is commonly maintained at the same pressure as suction plenum 64, via opening 102, and o-ring 104 is located between piston 56 and housing 54 to inhibit vapor flow along the interface therebetween. Also, preferably spring 106 is located within housing 54, below piston 56, to urge the piston upward, toward lever 46 and, ultimately, to urge suction valve 26 toward the open position. Such an arrangement insures that, upon starting of compressor 10, the compressor is unloaded, facilitating starting thereof.

As may be understood from a brief review of the above remarks, capacity control apparatus 22 may be easily employed to modulate the capacity of compressor 10 over a wide range of loads, allowing the compressor to satisfy these loads without frequently cycling on and off. Control apparatus 22 is relatively simple and inexpensive to manufacture and install, yet the control apparatus is very effective and highly reliable. Moreover, control apparatus 22 is comparatively compact and does not require modification of valve assembly 16, cylinder head 20, or the portions of cylinder block 12 defining cylinder chamber 60. Specifically, control apparatus 22 does not require increasing the projection of valve assembly 16 or cylinder head 20 above cylinder block 12—a factor which is of importance because compressors of the general type described above, particularly the cylinder head thereof, often closely fit within a hermetically sealed casing or shell. Further, it should be noted that, although only one cylinder chamber 60 and capacity control apparatus 22 are shown in the drawings and described above, compressor 10 may have a plurality of cylinder chambers; and any number, for example one, all, or some number therebetween, of the cylinder chambers may be provided with a capacity control apparatus 22, depending on the specific application of the compressor.

While it is apparent that the invention herein disclosed is well calculated to fulfill the objects stated above, it will be appreciated that numerous modifications and embodiments may be devised by those skilled in the art, and it is intended that the appended claims cover all such modifications and embodiments as fall within the true spirit and scope of the present invention.

What is claimed is:

1. Apparatus for modulating the capacity of a reciprocating compressor having a cylinder chamber and a valve assembly extending over the cylinder chamber, the valve assembly defining fluid inlet and outlet paths and including a suction valve having an annular plate for regulating fluid flow through the inlet path, the capacity modulating apparatus comprising:

a lever extending through the fluid inlet path and above the suction valve, and including a shoulder extending radially outside the valve assembly and having a first end located outside the valve assembly, and a second end engaging the suction valve and having first and second, spaced arms extending from the shoulder and engaging opposed, top sides of the annular plate, a fulcrum engaging the shoulder of the lever; and control means engaging the shoulder of the lever for applying a variable force thereto, wherein the lever transmits the force to the suction valve to urge the suction valve to an open position.

2. Capacity modulating apparatus as defined by claim 1 wherein the fulcrum is defined by the valve assembly.

3. Capacity modulating apparatus as defined by claim 2 wherein:

the valve assembly includes a plurality of pins extending through the fluid inlet path;

the lever defines a plurality of recesses; and the pins extend through the recesses to limit lateral movement of the lever.

4. A reciprocating compressor comprising:

a cylinder block defining a cylinder chamber;

a valve assembly extending over the cylinder chamber, defining fluid inlet and outlet paths, and including an annular suction valve for regulating fluid flow through the inlet path; and capacity modulating apparatus including a lever extending through the fluid inlet path and above the suction valve, and having first and second ends, the first end of the lever extending outside the valve assembly, the second end of the lever including first and second spaced arms engaging opposed, top sides of the suction valve, a fulcrum defined by the valve assembly and contacting an intermediate portion of the lever, and control means having a housing, a piston slidably disposed within the housing, lever engaging means connected to the piston and extending therefrom into engagement with the lever, and means for applying a variable control force to the piston, wherein the piston and the lever engaging means transmit the control force to the lever and the lever transmits the control force to the suction valve to urge the suction valve to an open position, the lever engaging means including coupling means to allow relative angular movement between the lever and the lever engaging means, and the means for applying a variable control force to the piston including means for adjusting a vapor pressure within the housing.

* * * * *